US006799821B1

(12) United States Patent
Okuda

(10) Patent No.: US 6,799,821 B1
(45) Date of Patent: Oct. 5, 2004

(54) METHOD OF DRIVING INK JET RECORDING HEAD

(75) Inventor: Masakazu Okuda, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/807,823

(22) PCT Filed: Oct. 14, 1999

(86) PCT No.: PCT/JP99/05678

§ 371 (c)(1),
(2), (4) Date: Apr. 19, 2001

(87) PCT Pub. No.: WO00/23278

PCT Pub. Date: Apr. 27, 2000

(30) Foreign Application Priority Data

Oct. 20, 1998 (JP) ..... 10-318443

(51) Int. Cl.[7] ..... B41J 29/38

(52) U.S. Cl. ..... 347/10; 347/11; 347/12; 347/68

(58) Field of Search ..... 347/11, 9, 10, 347/68, 12, 14

(56) References Cited

U.S. PATENT DOCUMENTS

| | | | | |
|---|---|---|---|---|
| 4,364,057 A | * | 12/1982 | Ebi et al. | 346/75 |
| 5,453,121 A | * | 9/1995 | Nicholls et al. | 106/20 B |
| 5,481,288 A | * | 1/1996 | Keeling et al. | 347/80 |
| 5,933,168 A | * | 8/1999 | Sakai | 347/70 |
| 6,467,865 B1 | * | 10/2002 | Iwamura et al. | 347/14 |

FOREIGN PATENT DOCUMENTS

| | | | |
|---|---|---|---|
| EP | 0 841 164 A1 | | 5/1998 |
| EP | 0 947 325 A1 | | 10/1999 |
| EP | 0947325 | * | 10/1999 |
| EP | 0 988 974 A2 | | 3/2000 |
| JP | 2-192947 | | 7/1990 |
| JP | 9-141851 | | 6/1997 |
| JP | 10-166579 | | 6/1998 |

* cited by examiner

*Primary Examiner*—HarHai Pham
*Assistant Examiner*—Lam Nguyen
(74) *Attorney, Agent, or Firm*—McGinn & Gibb, PLLC

(57) ABSTRACT

To enable fine droplets of a diameter smaller than a nozzle diameter to be stably ejected at a high driving frequency. The present invention relates to a method for driving an ink jet recording head which method applies a driving voltage to a piezoelectric actuator 4 to change a pressure in a pressure generating chamber 2, thus ejecting ink droplets 1 through a nozzle 7 in communication with the pressure generating chamber 2. A waveform of the driving voltage comprises a first voltage changing process for applying a voltage in a direction that inflates the pressure generating chamber 2, a second voltage changing process for then applying a voltage in a direction that compresses the volume of the pressure generating chamber, a third voltage changing process for applying a voltage in a direction that inflates the volume of the pressure generating chamber 2 again, and voltage changing times $t_2$ and $t_3$ during the second and third voltage changing processes are set to have such lengths as shown below, relative to a resonance frequency $T_c$ of a pressure wave generated in the pressure generating chamber 2: $0<t_2<T_c/2$ and $0<t_3<T_c/2$.

5 Claims, 17 Drawing Sheets

(a)

(b)

(a)

(b)

(a) NO RESTRAINT ON REVERBERATION (b) REVERBERATION RESTRAINED (a)

(b)

(a)

(b)

METHOD OF DRIVING INK JET RECORDING HEAD

TECHNICAL FIELD

The present invention relates to a method for driving an ink jet recording head which method ejects fine ink droplets through a nozzle to record characters or images.

BACKGROUND ART

One of such recording heads, what is called an on-demand ink jet recording head that ejects ink droplets through a nozzle depending on printed information, is conventionally commonly known (for example, see Japanese Patent Publication No. SHO 53-12138). FIG. 15 is a sectional view schematically showing a basic configuration of one of such on-demand ink jet recording heads which is called a Kyser type.

In this Kyser type recording head, on an ink upstream side, a pressure generating chamber 91 and a common ink chamber 92 are connected together via an ink supply hole (ink supply passage) 93, and on an ink downstream side, the pressure generating chamber 91 and a nozzle 94 are connected together, as shown in FIG. 15. Additionally, a bottom plate portion of the pressure generating section 91, which is located at the bottom of FIG. 15, comprises a diaphragm 95 having a piezoelectric actuator 96 on its rear surface.

With this configuration, during a printing operation, the piezoelectric actuator 96 is driven depending on printed information to displace the diaphragm 95, thereby changing the volume of the pressure generating chamber 91 rapidly to generate a pressure wave in the pressure generating section 91. The pressure wave causes a part of an ink filled in the pressure generating chamber 91 to be injected to an exterior through the nozzle 94 and ejected as ink droplets 97. The ejected ink droplets 98 arrived in a recording medium such as recording paper to form recording dots. Characters or images are recorded on the recording medium by repeating the formation of recording dots based on printing information.

The ink droplet ejecting operation will be further described. With this on-demand ink jet recording method or system, a single ink droplet is ejected whenever a driving voltage is applied to the piezoelectric actuator 96. In the prior art, however, to eject a single ink droplet, a trapezoidal driving voltage waveform is generally applied to the piezoelectric actuator 96.

The trapezoidal driving voltage waveform comprises a first voltage changing process 51 for linearly increasing a voltage V applied to the piezoelectric actuator 96 from a reference value up to a predetermined value $V_1$ to compress the pressure generating chamber 91 to eject the ink droplet 97, a voltage maintaining process 52 for maintaining the applied voltage V at the predetermined value $V_1$ for a certain amount of time (time $t_1'$), and a second voltage changing process 53 for subsequently returning the applied voltage $V_1$ to the reference voltage to return the compressed pressure generating chamber 91 to its original state, as shown in FIG. 16.

Movement of the piezoelectric actuator caused by an increase or decrease in driving voltage depends on the structure or polarization of the piezoelectric actuator, so some piezoelectric actuators move in a direction opposite to the movement direction of the above-mentioned piezoelectric actuator. Since, however, the reversely operating piezoelectric actuator performs an ejection operation similar to that described above when an opposite driving voltage is applied, a piezoelectric actuator that moves in a direction that compresses the pressure generating chamber when the applied voltage increases, while moving in a direction that inflates the pressure generating chamber when the applied voltage decreases will be described in the following "BEST MODE FOR CARRYING OUT THE INVENTION" for simple explanation.

In this ink jet recording head, since a single pixel is formed when the ink droplet 97 impacts on recording paper to form a recording dot, if the recording dot has a large diameter, it appears granular to prevent high image quality from being obtained. Thus, a dot size required to obtain a smooth image that does not appear granular (high image quality) is empirically assumed to be 40 $\mu$m or less, and a dot size of 25 $\mu$m or less is considered very preferable. Evidently, the size of the ejected ink droplet 97 may be reduced in order to obtain a small dot size. The relationship between the ink droplet size and the dot size depends on a flying speed (droplet speed) of the ink droplet 97, a physical property of the ink (e.g. viscosity or surface tension), the type of recording paper, or the like, but the dot size is normally about twice as large as the ink droplet size. Consequently, to obtain a dot size of 40 $\mu$m, the ink droplet size must be 20 $\mu$m, and to obtain a smaller size, for example, a dot size of 25 $\mu$m or less, the ink droplet size must be 12.5 $\mu$m or less.

On the other hand, it is theoretically known that if the ink droplet 97 is to be ejected through the nozzle 94 using a pressure wave, the volume q of the ejected ink droplet 97 is proportional to ① the opening area $A_n$ of the nozzle 94, ② the speed (droplet speed) Vd of the ink droplet 97, and ③ the resonance frequency (specific cycle) Tc of the pressure wave in the pressure generating chamber 91 (acoustic fundamental vibration mode) in the as shown in Equation (1). Accordingly, to reduce the size of the ink droplet 97, the nozzle opening diameter, the droplet speed $V_d$, and the resonance frequency $T_c$ of the pressure wave may be correspondingly reduced.

$$q \propto T_c V_d A_n \tag{1}$$

Thus, first, the resonance frequency $T_c$ of the pressure wave will be discussed. The resonance frequency $T_c$ of the pressure wave is reduced by reducing the volume of the pressure generating chamber 91 or increasing the rigidity of walls of the pressure generating chamber while reducing the acoustic capacity of the pressure generating chamber 91. When, however, the resonance frequency $T_c$ of the pressure wave is extremely reduced, for example, down to the order of several $\mu$s, a refilling operation is prevented from being operated smoothly, resulting in adverse effects on ejection efficiency, maximum driving frequency, or the like. Accordingly, the resonance frequency $T_c$ of the pressure wave has a minimum limit between 10 and 20 $\mu$s.

Next, the droplet speed $V_d$ of the ink droplet 97 will be described. The droplet speed $V_d$ affects the impact position accuracy of the ink droplet 97, and a lower droplet speed reduces the impact position accuracy of the ink droplet 97 because the ink droplet 97 is affected by an air flow. Consequently, the droplet speed $V_d$ of the ink droplet 97 cannot be extremely reduced only to reduce the droplet size, and must after all have a fixed value or more (normally about 4 to 10 m/s) in order to obtain high image quality.

Next, the nozzle opening diameter will be described. Due to the above described reasons, it is empirically known that if the resonance frequency $T_c$ of the pressure wave in the pressure generating chamber 91 filled with an ink is set between about 10 and 20 μs, the droplet speed $V_d$ of the ink droplet 97 is set between about 4 and 10 m/s, and the piezoelectric actuator 96 is driven using the driving voltage waveform shown in FIG. 16, then the minimum ink droplet size obtained is equivalent to the nozzle diameter 97. Accordingly, to obtain an ink droplet size of 20 μm, the nozzle diameter must be 20 μm, and to obtain an ink droplet size less than 20 μm, the nozzle diameter must be less than 20 μm. Forming a nozzle diameter less than 20 μm, however, makes manufacturing very difficult and increases the likelihood that the nozzle is blocked, thus significantly degrading the reliability and durability of the head. Thus, in fact, a nozzle diameter between 25 and 30 μm is presently a lower limit, so that under the above described conditions, the minimum droplet size obtained is between about 25 and 30 μm. It is expected that if the blocking problem is solved in the future, the lower limit of the nozzle diameter will extend to about 20 μm.

As a means for solving these problems, an ink jet driving method has been provided which applies an inversely trapezoidal driving voltage waveform to the piezoelectric actuator 96 to execute "pull and push" to thereby eject ink droplets smaller than the nozzle diameter, as described, for example, in Japanese Patent Laid-Open No. SHO 55-17589.

This driving voltage waveform comprises a first voltage changing process 54 for reducing the voltage V applied to the piezoelectric actuator 96, which is set at a reference voltage $V_1$ (>0 V), down to, for example, 0 V in order to inflate the pressure generating chamber 91, a voltage maintaining process 55 for maintaining the reduced applied voltage V at 0 V for a certain amount of time (time $t_1'$), and a second voltage changing process 56 for subsequently compressing the pressure generating chamber 91 to eject the ink droplet 97, while increasing the voltage V applied to the piezoelectric actuator 96 up to the original voltage $V_1$ in order to provide for the next ejection, as shown in FIG. 17.

When the pressure generating chamber is thus inflated immediately before the ejection, meniscus present at a nozzle opening surface is drawn to an interior of the nozzle, so that the ejection is started in a state where the meniscus has a depressed shape. Accordingly, this method is called "meniscus control", "pull and push" or the like.

According to this "meniscus control (pull and push)" driving method, the meniscus is drawn to the interior of the nozzle immediately before the ejection to reduce the amount of ink inside the nozzle, and ink droplets of a size smaller than the nozzle diameter are formed due to a change in droplet forming conditions before the ejection, thus achieving high quality recording. In addition to this, ejected ink droplets are unlikely to be affected by wetting of the nozzle opening surface, thereby making the ejection more stable.

In addition, Japanese Patent Laid-Open No. SHO 59-143655 proposes a means for using the meniscus control to modulate the droplet size by varying the amount of meniscus receding immediately before the ejection to eject ink droplets of different sizes through the same nozzle.

Further, several proposals have been made for the waveform of the driving voltage used for the meniscus control. For example, Japanese Patent Laid-Open No. SHO 59-218866 defines a time interval (timing) between the first voltage changing process 54 and the second voltage changing process 56 as a condition for easily obtaining fine droplets. Additionally, Japanese Patent Laid-Open No. HEI 2-192947 discloses a driving method of setting voltage changing times during the first and second voltage changing processes 54 and 56 as integral multiples of the resonance frequency $T_c$ of the pressure wave to prevent the pressure wave from reverberating after the ejection of ink droplets, thereby preventing the occurrence of satellites.

Results of experiments, however, show that even the meniscus controlling (pull and push) driving method (FIG. 17) described in the above publication can reduce the ink droplet size to only about 90% of the nozzle diameter, and it is thus practically difficult to obtain fine ink droplets of 20 μm or less to achieve high quality recording. That is, results of ejection experiments conducted by the inventors with a nozzle diameter of 30 μm, a pressure wave resonance frequency $T_c$ of 14 μs, and a droplet speed $V_d$ of 6 m/s and using the driving voltage waveform shown in FIG. 17 show that the droplet size obtained (equivalent size calculated from the total amount of ejected ink including satellites) has a lower limit of 28 μm even if the values of the reference voltage $V_1$, the voltage changing time (falling time) $t_1$ during the first voltage changing process 54, the voltage maintaining time $t_1'$ during the voltage maintaining process 55, and the voltage changing time (rising time) $t_2$ during the second voltage changing process 56 are varied and combined.

Further, if fast driving is executed with the inversely trapezoidal voltage waveform shown in FIG. 17, the pressure wave reverberates significantly after the ink ejection, resulting in unstable ejection such as delayed satellites or inappropriate ejection. In the experiments conducted by the inventors, when driving frequency exceeded 8 kHz, bubbles were entrained to the interior of the nozzle or satellite droplets adhered to peripheries of the nozzle, so that a decrease in droplet speed $V_d$ and inappropriate ejection were observed. It has been assured that the head used in the experiments can be driven at 10 kHz or more with the trapezoidal driving voltage waveform shown in FIG. 16, so that the inappropriate ejection evidently arises from a reverberated pressure wave, which is caused by the inversely trapezoidal driving voltage waveform.

On the other hand, in the driving voltage waveform shown in FIG. 17, if the falling time $t_1$ and the rising time $t_2$ are set equal to integral multiples of the resonance frequency $T_c$, the ejection can be kept stable but it becomes difficult to obtain fine droplets, as described in Japanese Patent Laid-Open No. HEI 2-192947. That is, the results of the experiments conducted by the inventors indicate that if the rising/falling time ($t_1/t_2$) is made equal to the resonance frequency $T_c$, the fine droplets obtained have a size of 35 μm when the nozzle diameter is 30 μm. Thus, it is difficult to obtain a droplet size equal to or smaller than the nozzle diameter.

The present invention is provided in view of the above described circumstances, and it is an object of the present invention to provide a method for driving an ink jet recording head which method enables fine ink droplets having a smaller size (for example, about 20 μm) than a nozzle to be stably ejected even at a high frequency.

DISCLOSURE OF THE INVENTION

To attain the above object, the invention set forth in claim 1 provides a method for driving an ink jet recording head which method applies a driving voltage to an electromechanical converter to deform the electromechanical converter to thereby change a pressure in the pressure generating chamber filled with an ink, thus ejecting ink droplets through a nozzle in communication with the pressure generating chamber, the method being characterized in that a voltage waveform of the driving voltage comprises at least a first voltage changing process for applying a voltage in a direction that increases a volume of the pressure generating chamber, a second voltage changing process for then applying a voltage in a direction that reduces the volume of the pressure generating chamber, a third voltage changing process for applying a voltage in a direction that increases the volume of the pressure generating chamber again, and voltage changing times $t_2$ and $t_3$ during the second and third voltage changing processes are set to have such lengths as shown below, relative to a resonance frequency $T_c$ of a pressure wave generated in the pressure generating chamber:

$$0<t_2<T_c/2$$

$$0<t_3<T_c/2.$$

The invention set forth in claim 2 is the method for driving an ink jet recording head according to 1, characterized in that a start time of the third voltage changing process is the same as an end time of the second voltage changing process.

The invention set forth in claim 3 is the method for driving an ink jet recording head according to claim 1 or 2, characterized in that the voltage waveform of the driving voltage includes a fourth voltage changing process for applying a voltage in a direction that reduces the voltage of the pressure generating chamber, after the first voltage changing process, the second voltage changing process, and the third voltage changing process.

The invention set forth in claim 4 is the method for driving an ink jet recording head according to claim 3, characterized in that a voltage changing time $t_4$ during the fourth voltage changing process is set as follows relative to the resonance frequency $T_c$ of the pressure wave generated in the pressure generating chamber:

$$0<t_4<T_c/2.$$

The invention set forth in claim 5 is the method for driving an ink jet recording head according to claim 3 or 4, characterized in that a time interval between a start time of the second voltage changing process and a start time of the fourth voltage changing process is set substantially half the length of the resonance frequency $T_c$ of the pressure wave generated in the pressure generating chamber.

The invention set forth in claim 6 is the method for driving an ink jet recording head according to any of claims 1 to 5, characterized in that the electomechanical converter is a piezoelectric actuator.

The invention set forth in claim 7 is the method for driving an ink jet recording head according to any of claims 1 to 5, characterized in that an ink jet recording head with the nozzle of 20 to 40 $\mu$m opening diameter is driven to eject ink droplets of 5 to 25 $\mu$m size.

THEORETICAL VALIDITY OF THE INVENTION

A theoretical ground for the validity of the present invention will be explained with reference to a lumped-parameter equivalent circuit model.

FIG. 12(*a*) is an equivalent electrical circuit diagram showing that the ink jet recording head shown in FIG. 1 is filled with an ink. In FIG. 12(*a*), reference $m_0$ denotes the inertance (acoustic mass) [kg/m$^4$] of a vibration system comprising a piezoelectric actuator 4 and a diaphragm 3, reference $m_2$ denotes the inertance of an ink supply hole 6, reference $m_3$ denotes the inertance of a nozzle 7, reference $r_2$ denotes an acoustic resistance [Ns/m$^5$] from the ink supply hole 6, reference $r_3$ denotes an acoustic resistance from the nozzle 7, reference $c_0$ denotes the acoustic capacity [m$^5$/N] of the vibration system, reference $c_1$ denotes the acoustic capacity of the pressure generating chamber 2, reference $c_2$ denotes the acoustic capacity of the ink supply hole 6, reference $c_3$ denotes the acoustic capacity of the nozzle 7, and reference $\phi$ denotes a pressure [Pa] effected on the ink.

In this case, if the piezoelectric actuator 4 comprises a rigid laminated piezoelectric actuator, the inertance $m_0$ and acoustic capacity $C_0$ of the vibration system are negligible. Accordingly, the equivalent circuit in FIG. 12(*a*) is approximately represented by the equivalent circuit in FIG. 12(*b*).

Additionally, if it is assumed that the relation expression $m_2=km_3$ is established between the inertances $m_2$ and $m_3$ of the ink supply hole 6 and the nozzle 7 and that the relation expression $r_2=kr_3$ is established between the acoustic resistances $r_2$ and $r_3$ from the ink supply hole 6 and the nozzle 7 and if circuit analysis is carried out for a case where a driving voltage waveform having a rising angle $\theta$ is input as shown in FIG. 13(*a*), then a volume velocity $u_3'$ [m$^3$/s] in the nozzle section 7 during a rising time $0 \leqq t \leqq t_1$ is given by Equation (2).

$$u_3'(t,\theta)=\frac{c_1\tan\theta}{\left(1+\frac{1}{k}\right)}\left[1-\frac{w}{E_c}\exp(-D_c\cdot t)\sin(E_c t-\phi_0)\right](0\le t\le t_1) \tag{2}$$

Here is, $$E_c=\sqrt{\frac{1+\frac{1}{k}}{c_1 m_3}-D_c^2}$$

$$D_c=\frac{r_3}{2m_3}$$

$$w^2=\frac{1+\frac{1}{k}}{c_1 m_3}$$

$$\phi_0=\tan^{-1}\frac{E_c}{D_c}$$

Next, the volume velocity obtained using a driving voltage waveform of a complicated shape (trapezoid) as shown in FIG. 13(*b*) can be determined by superposing together pressure waves generated at nodes (points A, B, C, and D) of the driving voltage waveform. That is, the volume velocity $u_3$ [m$^3$/s] in the nozzle section 7 as occurring in the driving voltage waveform in FIG. 13(*b*) is given by Equation (3).

$$\left.\begin{aligned}
&u_3(t)=u_3'(t,\theta_1) && (0\le t\le t_1)\\
&u_3(t)=u_3'(t,\theta_1)+u_3'(t-t_1,\theta_2) && (t_1\le t\le t_1+t_1')\\
&u_3(t)=u_3'(t,\theta_1)+u_3'(t-t_1,\theta_2)+ && (t_1+t_1'\le t\le t_1'+t_2)\\
&\qquad u_3'(t-(t_1+t_1'),\theta_3) && \\
&u_3(t)=u_3'(t,\theta_1)+u_3'(t-t_1,\theta_2)+ && (t\ge t_1+t_1'+t_2)\\
&\qquad u_3'(t-(t_1+t_1'),\theta_3)+ && \\
&\qquad u_3'(t-(t_1+t_1'+t_2),\theta_4) &&
\end{aligned}\right\} \tag{3}$$

When the volume velocity $u_3$ is actually determined for the driving voltage waveform in FIG. 13(*a*) using Equation (3), the result indicates that temporal variations in volume velocity $u_3$ vary significantly depending on the rising time $t_1$. FIG. 14 shows an example. In an area corresponding to $t_1<T_c$ ($T_c$: resonance frequency of pressure waves), the volume velocity $u_3$ becomes zero earlier (the time (t")) as the rising time $t_1$ decreases (a)→(b)→(c) in FIG. 14.

The particle velocity in the figure is defined as a value obtained by dividing the volume velocity $u_3'$ of the nozzle section 7 by the opening area of the nozzle. Thus, since the driving voltage waveform significantly varies the waveform of the volume velocity of the nozzle section 7, this can be used as a principle of fine-droplet ejection. This is because the volume q of ejected droplets is substantially proportional to the shaded area in FIG. 14, as is apparent from what is expressed by Equation (4).

$$q \propto \int_{t'}^{t''} u(t)dt \quad (4)$$

That is, setting a small rising time $t_1$ reduces the area of the shaded portion, thereby obtaining a small volume of droplets (droplet size) q. In particular, fine droplets can be ejected by setting the rising time $t_1$ equal to or shorter than half of the resonance frequency $T_c$ of the pressure wave (this also applies to the falling time $t_2$).

If the driving voltage waveform shown in FIG. 17 is used to execute meniscus control (pull and push), it is particularly desirable for fine-droplet ejection to set the rising time $t_2$ equal to or shorter than half of the resonance frequency $T_c$ of the pressure wave. This is because ink droplets can be made further smaller due to the droplet size reducing effect based on the conventional meniscus control as well as the above-described variation of the volume velocity waveform (a decrease in shaded area).

However, it is very difficult to obtain fine droplets of 20 μm size simply by setting a shorter rising time $t_2$ for the inversely trapezoidal driving voltage waveform shown in FIG. 17. Thus, if the piezoelectric actuator 4 is imparted with a third voltage changing process (voltage lowering process) for rapidly increasing the volume of the pressure generating chamber 2 immediately after the driving voltage waveform has risen, as shown in FIG. 4(*a*), then the shaded area further decreases to enable the ink droplets to be made further smaller, as shown in FIG. 5(*a*). Additionally, the effect of the falling edge on the reduction of the droplet size depends on the time interval between the rising and falling edges; if the falling edge is set to appear immediately after the rising edge, that is, the start time of the third voltage changing process is set equal to the end time of the second voltage changing process, as shown in FIG. 4(*b*), the smallest droplet diameter is obtained as shown in FIG. 5(*b*).

Further, as described above, the use of a driving voltage waveform having a rapid rising or falling edge causes the pressure wave to reverberate significantly after the ejection, so that a problem such as generation of satellites or a reduced stability of fast driving is likely to occur. Thus, according to the inventions set forth in claims 3, 4, and 5, a fourth voltage changing process (voltage raising process) for generating pressure waves to restrain reverberation is provided after the third voltage changing process. This serves to compensate for previously generated pressure waves to prevent reverberation, while improving the ejection stability.

BRIEF DESCRIPTION OF THE DRAWINGS

FIG. 1(*b*) is an exploded sectional view showing the ink jet recording head as disassembled;

BEST MODE FOR CARRYING OUT THE INVENTION

The best mode for carrying out the present invention will be described below with reference to the drawings. A specific description will be given using embodiments.

FIRST EMBODIMENT

Figure 1:
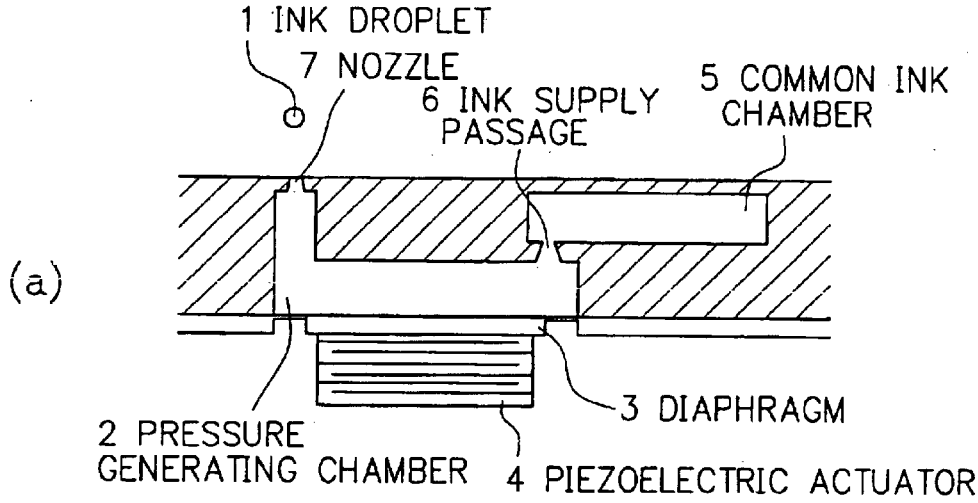
FIG. 1(*a*) is a sectional view of an ink jet recording head mounted in an ink jet recording apparatus as a first embodiment of the present invention.
Figure 1:
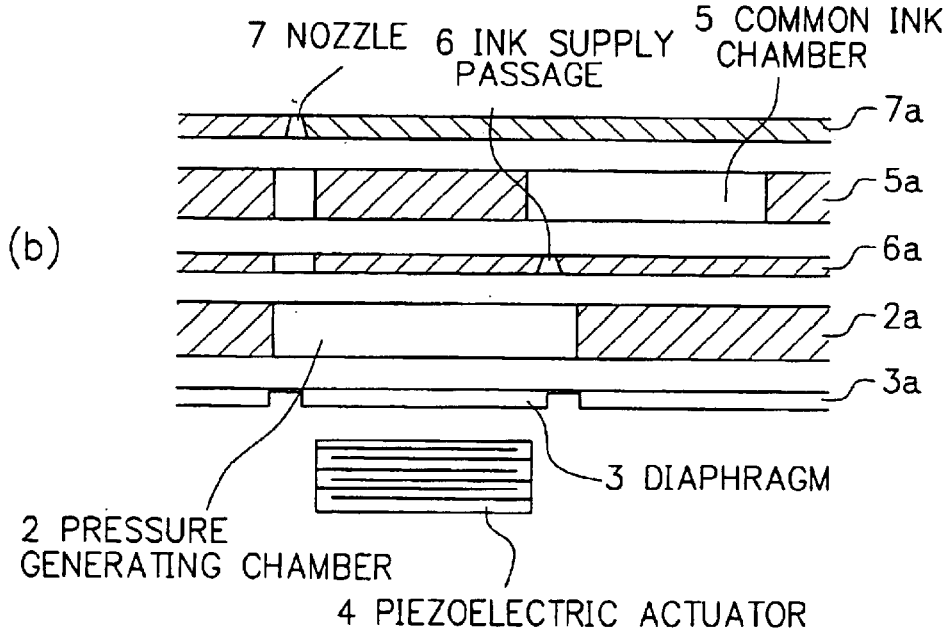
Figure 2:
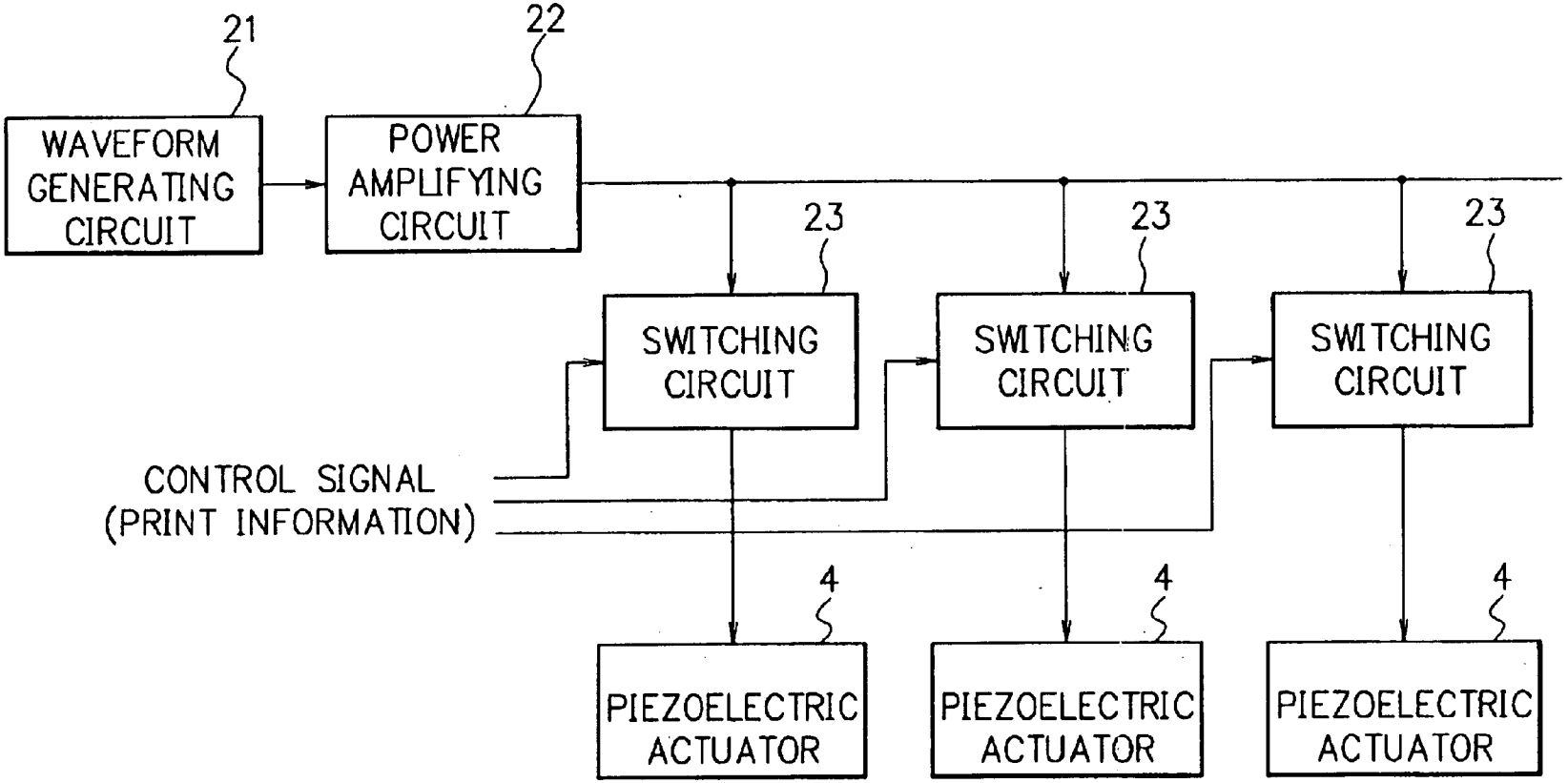
FIG. 2 is a block diagram showing the electrical configuration of a droplet size non-modulated driving circuit for driving the ink jet recording head.
Figure 3:
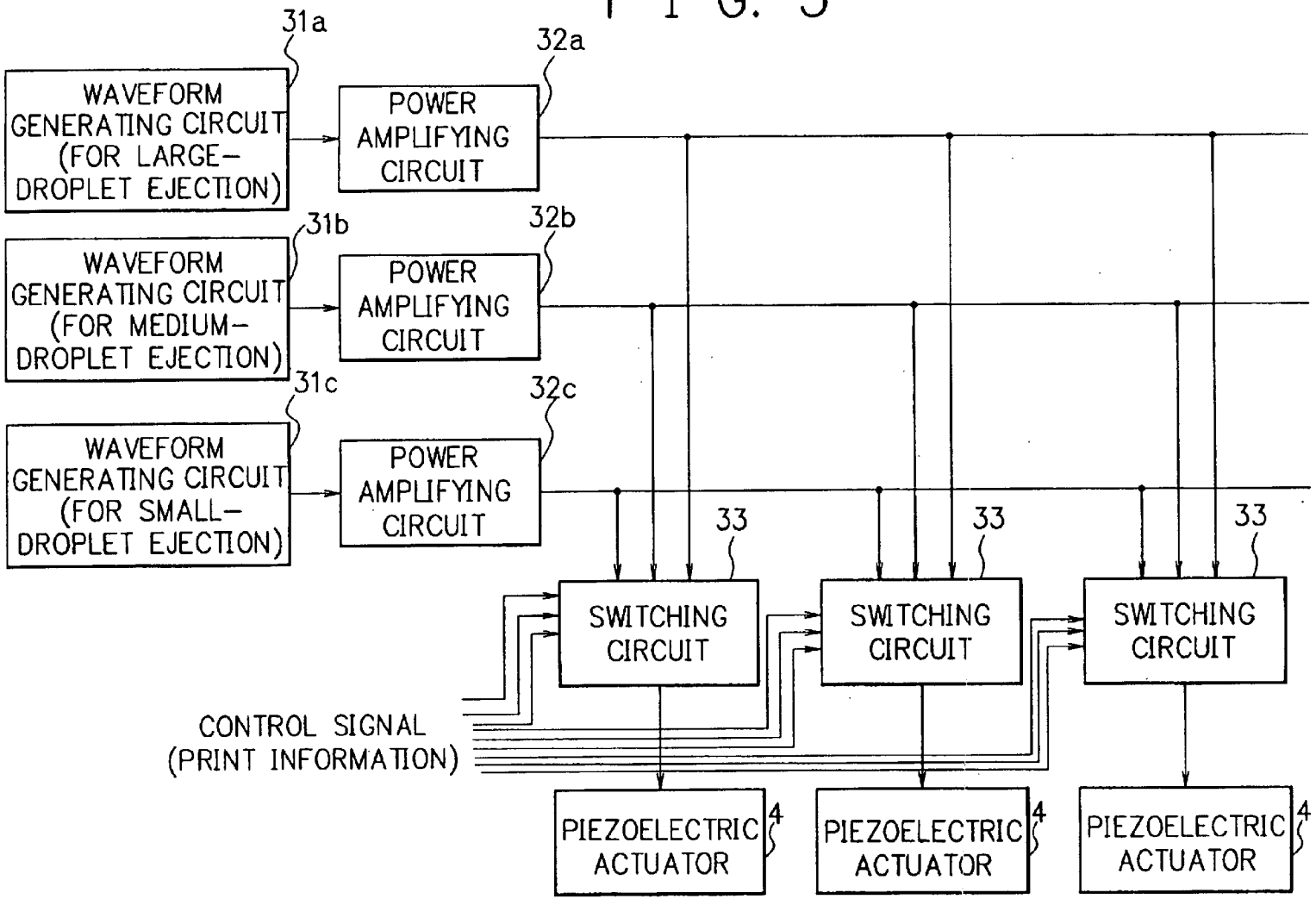
FIG. 3 is a block diagram showing the electrical configuration of the droplet size modulated driving circuit for driving the ink jet recording head.
Figure 4:
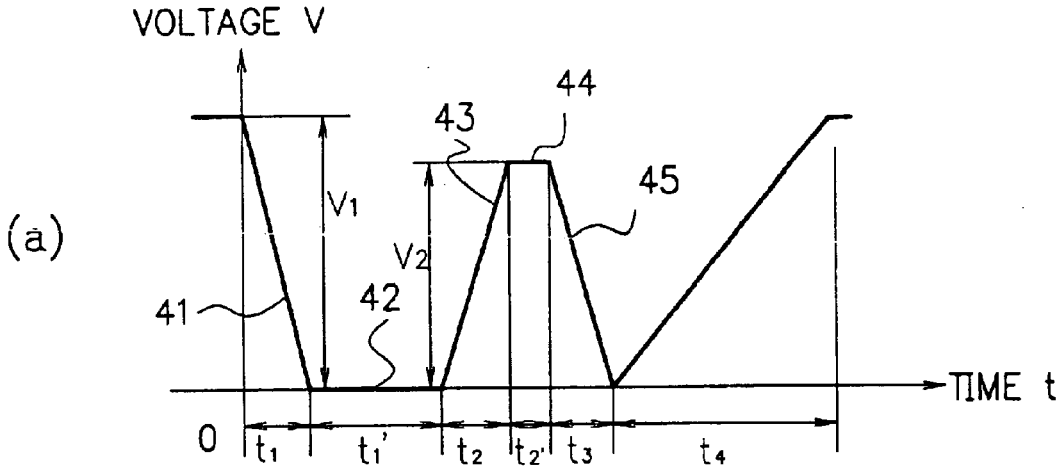
FIG. 4 is a waveform diagram showing the configuration of driving voltage waveforms used in a method for driving the ink jet recording head.
Figure 4:
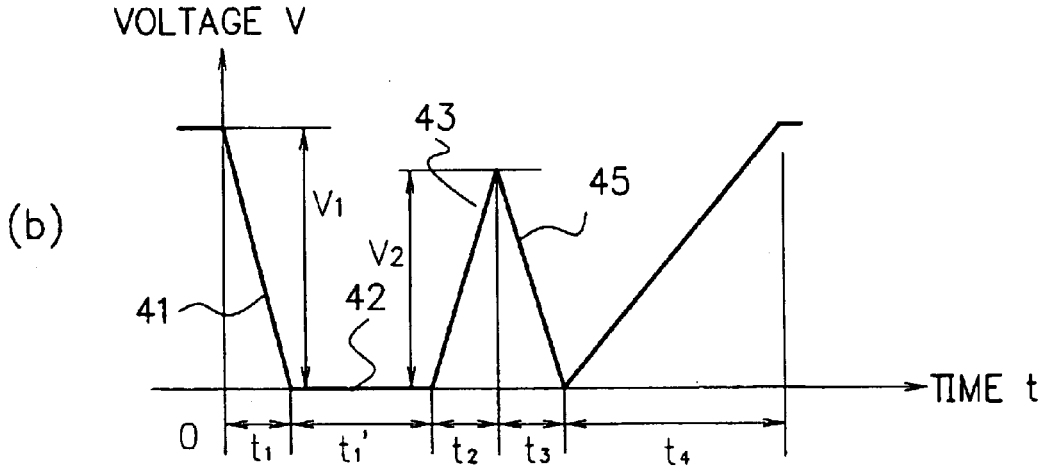
Figure 5:
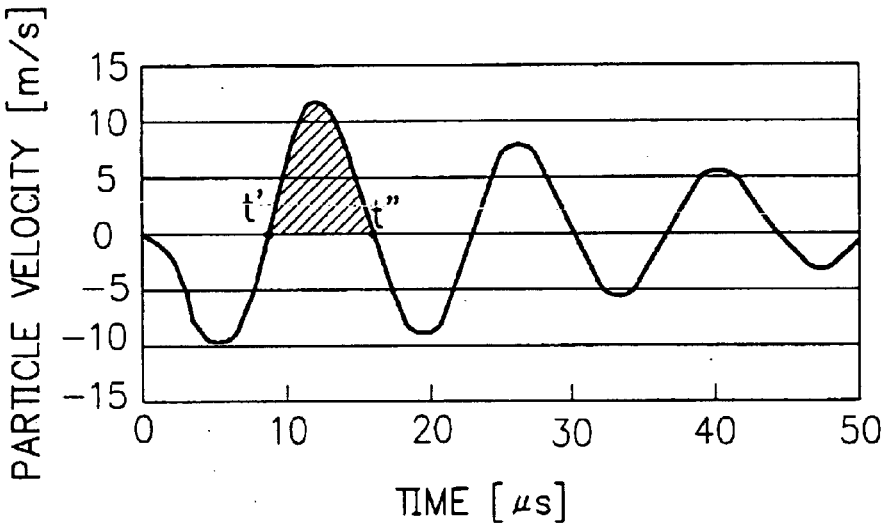
FIG. 5 is a waveform diagram showing waveforms of the volume velocity of an ink as occurring in a nozzle section due to the driving voltage waveform.
Figure 5:
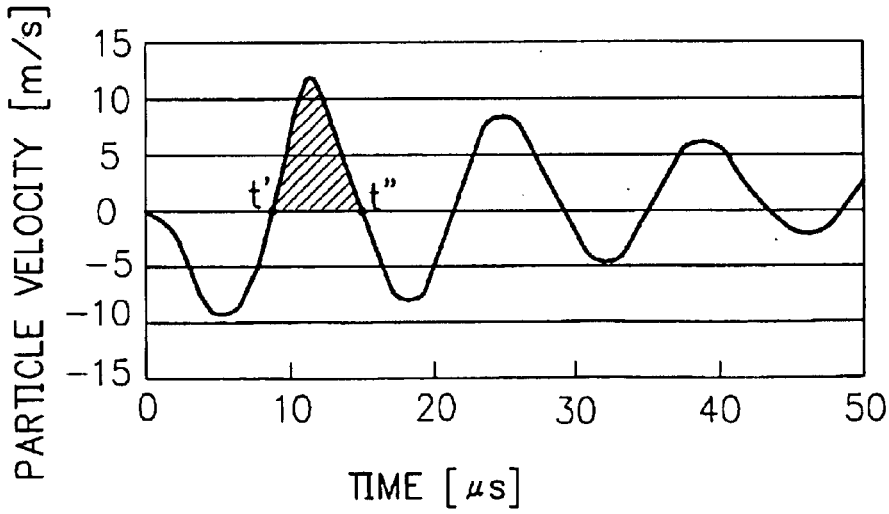
Figure 6:
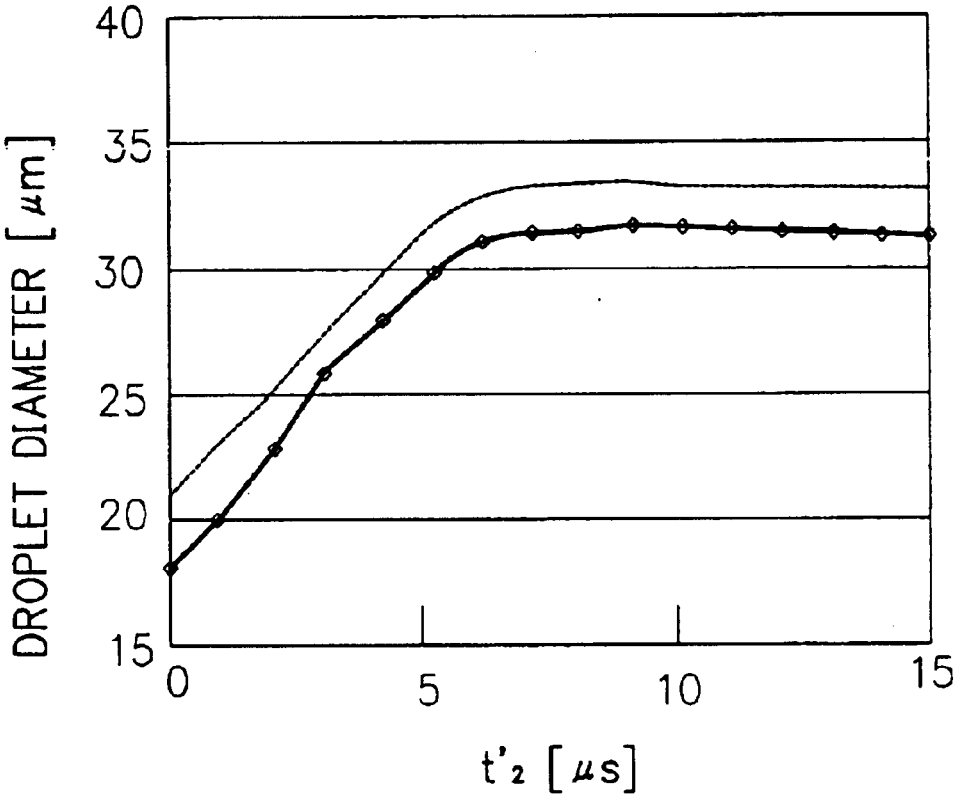
FIG. 6 is a view useful in explaining the effects of this embodiment.
Figure 7:
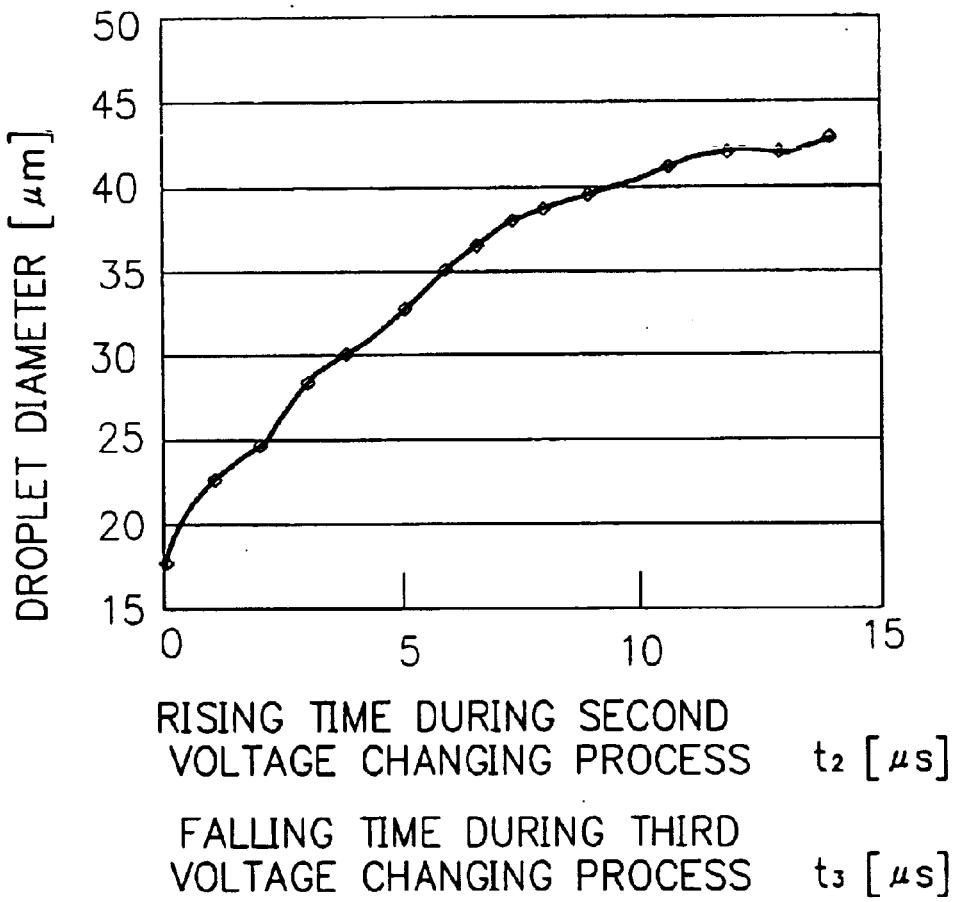
FIG. 7 is a view useful in explaining the effects of this embodiment.

FIG. 1(*a*) is a sectional view showing the configuration of an ink jet recording head mounted in an ink jet recording apparatus as a first embodiment of the present invention. FIG. 1(*b*) is an exploded sectional view showing the ink jet recording head as disassembled. FIG. 2 is a block diagram showing the electrical configuration of a droplet size non-modulated driving circuit for driving the ink jet recording head. FIG. 3 is a block diagram showing the electrical configuration of the droplet size modulated driving circuit for driving the ink jet recording head. FIG. 4 is a waveform diagram showing the configuration of driving voltage waveforms used in a method for driving the ink jet recording head. FIG. 5 is a waveform diagram (already described) showing waveforms of the volume velocity of an ink as occurring in a nozzle section due to the driving voltage waveform. FIGS. 6 and 7 are views useful in explaining the effects of this embodiment.

The ink jet recording head in this example relates to a on-demand Kyser type multinozzle recording head for ejecting ink droplets 1 as required to print characters or images on recording paper as shown in FIG. 1(*a*), and as shown in FIG. 1, comprises a plurality of pressure generating chambers 2 each formed into an elongated cubic and arranged in a direction perpendicular to the sheet of the drawing, a diaphragm 3 constituting a bottom surface of each of the pressure generating chambers 2, which is located at the bottom of FIG. 1, a plurality of piezoelectric actuators 4 arranged in parallel on a rear surface of the diaphragm correspondingly to the pressure generating chambers 2 and composed of laminated piezoelectric ceramics, a common ink chamber (ink pool) 5 linked to an ink tank (not illustrated) to supply an ink to each of the pressure generating chambers 2, a plurality of ink supply holes (communication holes) 6 for allowing the common ink chamber 5 to communicate with each pressure generating chamber 2 on a one-to-one correspondence, and a plurality of nozzles 7 formed so as to correspond to the different pressure generating chambers 2 and ejecting the ink droplets 1 from an angled tip portion projecting upward from each pressure generating chamber 2 as shown in FIG. 1. In this case, the common ink chamber 5, the ink supply passages 6, the pressure generating chambers 2, and the nozzles 7 form a channel system through which the ink moves in this order, the piezoelectric actuator 4 and the diaphragm 3 constitute a vibration system for applying pressure waves to the ink in the pressure generating chambers 2, and contacts between the channel system and the vibration system constitute the bottom surface of the pressure generating chambers 2 (that is, a top surface of the diaphragm 3, which is located closer to the bottom of the figure).

In a process of manufacturing a head according to this embodiment, the following components are provided beforehand: a nozzle plate 7*a* having the plurality of nozzles 7 formed by drilling the nozzle plate by means of precision pressing and arranged in rows or in a staggered manner, in a (super-) periodic or in having any periodical shift, a pool plate 5*a* having a space portion formed for the common ink chamber 5, a supply hole plate 6*a* having the ink supply holes 6 drilled therein, a pressure generating chamber plate 2*a* having space portions for the plurality of pressure generating chambers 2, and a vibration plate 3*a* constituting the plurality of diaphragms 3, as shown in FIG. 1(*b*). These plates 2*a*, 3*a*, and 5*a* to 7*a* are bonded and joined together using an epoxy-based adhesive layer of 20 μm thickness (not illustrated) to thereby produce a laminated plate. Then, the produced laminated plate and the piezoelectric actuators 4 are joined together using an epoxy-based adhesive layer to thereby manufacture an ink jet recording head of the above configuration. In this example, the vibration plate 3*a* comprises a nickel plate of 50 to 75 μm molded by means of electroforming, while the other plates 2*a* and 5*a* to 7*a* each comprise a stainless plate of 50 to 75 μm. The nozzles 7 in this example each have an opening diameter of about 30 μm, a bottom diameter of about 65 μm, and a length of about 75 μm and are each tapered in a manner such that its diameter increases toward the pressure generating chamber 2. The ink supply holes 6 are also each formed to have the same shape as the nozzle 7.

Next, the electrical configuration of a drive circuit for driving the ink jet recording head of this example configured as stated above will be described with reference to FIGS. 2 and 3.

The ink jet recording apparatus of this example has a CPU (Central Processing Unit) (not illustrated), a ROM, a RAM, and the like. The CPU executes programs stored in the ROM and uses various registers and flags stored in the RAM to control each section of the apparatus so as to print characters or images on recording paper based on print information supplied from a higher apparatus such as a personal computer via an interface.

First, the driving circuit in FIG. 2 generates a driving voltage waveform signal corresponding to FIG. 4(*a*), amplify the power of this signal, and then supplies the amplified signal to the predetermined piezoelectric actuators 4, 4, . . . corresponding to print information to drive them to eject the ink droplets 1 always having substantially the same size, thereby printing characters or images on recording paper. The driving circuit substantially comprises a waveform generating circuit 21, a power amplifying circuit 22, and a plurality of switching circuits 23, 23, . . . connected to the piezoelectric actuators 4, 4, . . . on a one-to-one correspondence.

The waveform generating circuit 21 comprises a digital analog conversion circuit and an integration circuit to convert driving voltage waveform data read out from a predetermined storage area of the ROM, into analog data, and then integrates the latter to generate a driving voltage waveform signal corresponding to FIG. 4(*a*). The power amplifying circuit 22 amplifies the power of the driving voltage waveform signal supplied by the waveform generating circuit 21 to output an amplified driving voltage waveform signal, shown in FIG. 4(*a*). The switching circuit 23 has its input end connected to an output end of the power amplifying circuit 22 and its output end connected to one end of the corresponding piezoelectric actuator 4. When a control signal corresponding to print information output from a drive controlling circuit (not illustrated) is input to a control end of the switching circuit 23, the latter is switched on to apply the amplified driving voltage waveform signal (FIG. 4(*a*)) output from the corresponding power amplifying circuit 22, to the piezoelectric actuator 4. Then, the piezoelectric actuator 4 displaces the diaphragm 3 depending on the applied amplified driving voltage waveform signal, to change the volume of the pressure generating chambers 2. Consequently, a predetermined pressure wave is generated in the pressure generating chambers 2 filled with an ink, thereby ejecting the ink droplets 1 of a predetermined size through the nozzles 7. In the recording head of this embodiment, the pressure wave in the pressure generating chambers 2 filled with the ink has a resonance frequency $T_c$ of 14 μs. The ejected ink droplets impact on recording medium such as recording paper to form recording dots. The formation of recording dots is then repeated based on the print information to record characters or images on the recording paper in a binary form.

Next, the driving circuit in FIG. 3 is of what is called a droplet size modulated type which switches the size of the ink droplets ejected through the nozzle, between multiple levels (in this example, three levels including large droplets of 40 μm size, medium droplets of 30 μm size, and small droplets of 20 μm size) to print characters or images on the recording paper with multiple gradations. The driving circuit substantially comprises three types of waveform generating circuits 31*a*, 31*b* and 31*c* corresponding to the droplet sizes, power amplifying circuits 32*a*, 32*b*, and 32*c* connected to these waveform generating circuits 31*a*, 31*b*, and 31*c* on a one-to-one correspondence, and a plurality of switching circuits 33, 33, . . . connected to the piezoelectric actuators 4, 4, . . . on a one-to-one correspondence.

The waveform generating circuits 31*a* to 31*c* each comprise a digital analog conversion circuit and an integration circuit, and one 31*a* of these waveform generating circuits 31*a* to 31*c* converts driving voltage waveform data for large-droplet ejection into analog data, the signal being read out by the CPU from a predetermined storage area of the ROM, and then integrates this signal to generate a driving voltage waveform signal for large-droplet ejection. The waveform generating circuit 31*b* converts driving voltage waveform data for medium-droplet ejection into analog data, the signal being read out by the CPU from a predetermined storage area of the ROM, and then integrates this signal to generate a driving voltage waveform signal for medium-droplet ejection. Additionally, the waveform generating circuit 31*c* converts driving voltage waveform data for small-droplet ejection into analog data, the signal being read out by the CPU from a predetermined storage area of the ROM, and then integrates this signal to generate a driving voltage waveform signal for small-droplet ejection corresponding to FIG. 4(*a*). The power amplifying circuit 32*a* amplifies the power of the driving voltage waveform signal for large-droplet ejection supplied by the waveform generating circuit 31*a* to output an amplified driving waveform signal for large-droplet ejection. The power amplifying circuit 32*b* amplifies the power of the driving voltage waveform signal for medium-droplet ejection supplied by the waveform generating circuit 31*b* to output an amplified driving voltage waveform signal for medium-droplet ejection.

The power amplifying circuit 32*c* amplifies the power of the driving voltage waveform signal for small-droplet ejection supplied by the waveform generating circuit 31*c* to output an amplified driving voltage waveform signal for small-droplet ejection (FIG. 4(*a*)).

Further, the switching circuit 33 comprises a first, a second, and a third transfer gates (not illustrated). The first transfer gate has its input end connected to the output end of the power amplifying circuit 32*a*, the second transfer gate has its input end connected to the output end of the power amplifying circuit 32*b*, and the third transfer gate has its input end connected to the output end of the power amplifying circuit 32*c*. The first, second, and third transfer gates have their output ends connected to one end of the corresponding common piezoelectric actuator 4. When a gradation controlling signal corresponding to print information output from a drive controlling circuit (not illustrated) is input to a control end of the first transfer gate, the latter is turned on to apply to the piezoelectric actuator 4 the amplified driving voltage waveform signal for large-droplet ejection output from the power amplifying circuit 32*a*.

At this time, the piezoelectric actuator 4 displaces the diaphragm 3 depending on the applied amplified driving voltage waveform signal to rapidly change (increase or reduce) the volume of the pressure generating chamber 2 to thereby generate a predetermined pressure wave in the pressure generating chamber 2 filled with the ink, thus ejecting the large ink droplets 1 through the nozzle 7. When a gradation controlling signal corresponding to print information output from the drive controlling circuit is input to a control end of the second transfer gate, the latter is turned on to apply to the piezoelectric actuator 4 the amplified driving voltage waveform signal for medium-droplet ejection output from the power amplifying circuit 32*b*. At this time, the piezoelectric actuator 4 displaces the diaphragm 3 depending on the applied amplified driving voltage waveform signal to rapidly change (increase or reduce) the volume of the pressure generating chamber 2 to thereby generate a predetermined pressure wave in the pressure generating chamber 2 filled with the ink, thus ejecting the medium ink droplets 1 through the nozzle 7. When a gradation controlling signal corresponding to print information output from the drive controlling circuit is input to a control end of the third transfer gate, the latter is turned on to apply to the piezoelectric actuator 4 the amplified driving voltage waveform signal for small-droplet ejection output from die power amplifying circuit 32*c* (FIG. 4(*a*)). At this time, the piezoelectric actuator 4 displaces the diaphragm 3 depending on the applied amplified driving voltage waveform signal to rapidly change (increase or reduce) the volume of the pressure generating chamber 2 to thereby generate a predetermined pressure wave in the pressure generating chamber 2 filled with the ink, thus ejecting the small ink droplets 1 through the nozzle 7. The ejected ink droplets impact on the recording medium such as recording paper to form recording dots. The formation of such recording dots is repeated based on print information to record characters or images on recording paper.

In this embodiment, an ink jet recording apparatus exclusively used for binary recording incorporates the driving circuit in FIG. 2, and an ink jet recording apparatus also used for gradation recording incorporates the driving circuit in FIG. 3.

The above-mentioned amplified driving voltage waveform signal comprises a first voltage changing process 41 for lowering a voltage V applied to the piezoelectric actuator 4 ($V_1 \rightarrow 0$) to inflate the pressure generating chamber 2 to thereby cause meniscus to recede, a first voltage retaining process 42 for retaining the lowered applied voltage V for a certain period of time (time $t_1'$)($0 \rightarrow 0$), a second voltage changing process 43 for raising the voltage ($0 \rightarrow V_2$) to compress the pressure generating chamber 2 to eject the ink droplets 1, a second voltage retaining process 44 for retaining the raised applied voltage V for a certain period of time (time $t_2'$) ($V_2 \rightarrow V_2$), and a third voltage changing process 45 for lowering the voltage ($V_2 \rightarrow 0$) to inflate the pressure generating chamber 2 again. The voltage changing times $t_2$ and $t_3$ during the second and third voltage changing processes 43 and 45 are set to have such lengths as shown below, relative to the resonance frequency $T_c$ of the pressure wave generated in the pressure generating chamber 2.

$$0<t_2<T_c/2$$

$$0<t_3<T_c/2$$

Next, ejection experiments were conducted for the ink jet driving method of this example under the following driving voltage waveform conditions:

reference voltage $V_1$=10 V voltage changing time $t_1$=3 μs during the first voltage changing process 41 voltage retaining time $t_1'$=4 μs during the first voltage retaining process 42 voltage changing time $t_2$=2 μs during the second voltage changing process 43 voltage changing time $t_3$=2 μs during the third voltage changing process 45

The voltage retaining time $t_2'$ during the second voltage retaining process 44 was varied and resulting variations in droplet diameter were recorded. The voltage change amount $V_2$ during ejection, that is, during the second voltage changing process 43 was adjusted such that a droplet speed was always 6 m/s. FIG. 6 is a characteristic diagram showing the relationship between the voltage retaining time $t_2'$ during the second voltage retaining process 44 and the ink droplet size. In this diagram, the solid line shows measured values obtained under the above-mentioned conditions, and the broken line shows converted values of the droplet size obtained by calculating a volume speed $u_3$ in the nozzle portion 7, substituting the result of the calculation for Equation (4) to calculate the droplet volume q, and determining a droplet size from the calculated droplet volume q. As seen in FIG. 6, the theoretical values agree well with the experimental values despite a small difference in absolute value.

As seen in FIG. 6, the addition of the third voltage changing process 45 enables the ink droplets to be made significantly small. In particular, it has been assured that if an end time of the second voltage changing process 43 is the same as a start time of the third voltage changing process 45, that is, the voltage retaining time $t_2'$ during the second voltage retaining process 44 is set at 0 μs, as shown in FIG. 4(*b*), ink droplets of the smallest diameter (19 μm) are obtained to enable fine droplets in the order of 20 μm to be ejected.

Then, with the voltage retaining time $t_2'$ during the second voltage retaining process 44 set at 0 μs, the voltage changing time (rising time $t_2$) during the second voltage changing process 43 and the voltage changing time (falling time $t_3$) during the third voltage changing process 45 were varied, and variations in ink droplet diameter were measured. FIG. 7 is a graph showing the relationship between the falling time $t_2$/rising time $t_3$ and the ink droplet size. FIG. 7 shows that fine ink droplets are effectively ejected by setting the falling time $t_2$/rising time $t_3$ equal to or shorter than half of the resonance frequency $T_c$ of the pressure wave.

The size of ejected ink droplets depends on the resonance frequency $T_c$ of the pressure wave or the nozzle diameter as is apparent from Equation (1), and fine droplets in the order of 20 μm are not necessarily obtained even by setting the rising time $t_2$/falling time $t_3$ during the second voltage changing process 43/third voltage changing process 45 equal to or shorter than half of the resonance frequency $T_c$. That is, setting the rising time $t_2$/falling time $t_3$ equal to or shorter than half of the resonance frequency $T_c$ is not a sufficient but a necessary condition.

Figure 17:
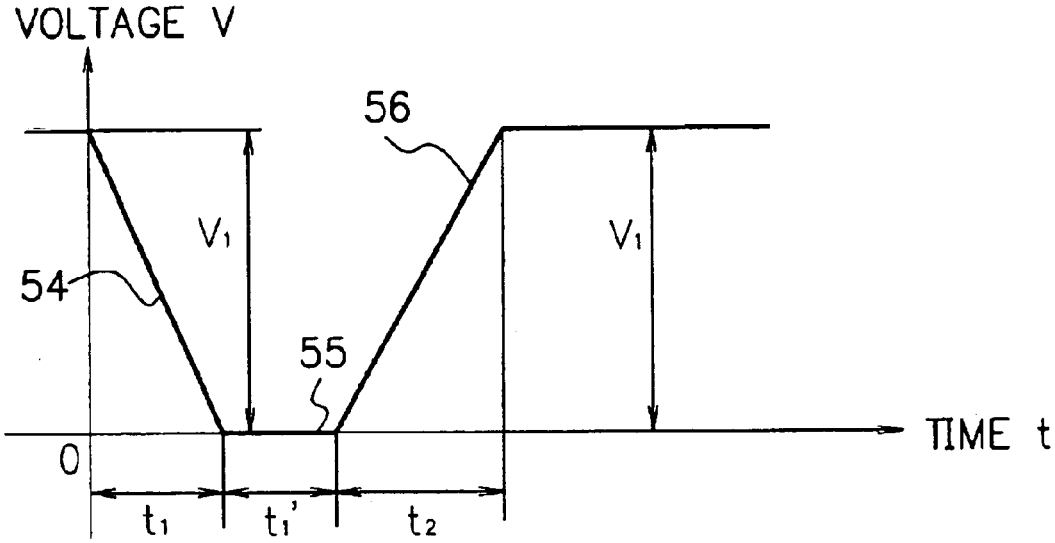
FIG. 17 is a waveform diagram showing the configuration of driving voltage waveforms used in another conventional method for driving a ink jet recording head.

Next, for comparison with the prior art, ejection experiments were conducted using the conventional driving voltage waveform in FIG. 17. That is, the following conditions were set:

- reference voltage $V_1$=10 V
- voltage changing time $t_1$=3 μs during a first voltage changing process 54
- voltage retaining time $t_1'$=4 μs during a first voltage retaining process 5

A rising time $t_3$ during ejection, that is during a second voltage changing process 56 was varied and resulting variations in droplet diameter were recorded. The voltage change amount $V_2$ during ejection was adjusted such that the droplet speed was always 6 m/s.

Figure 8:
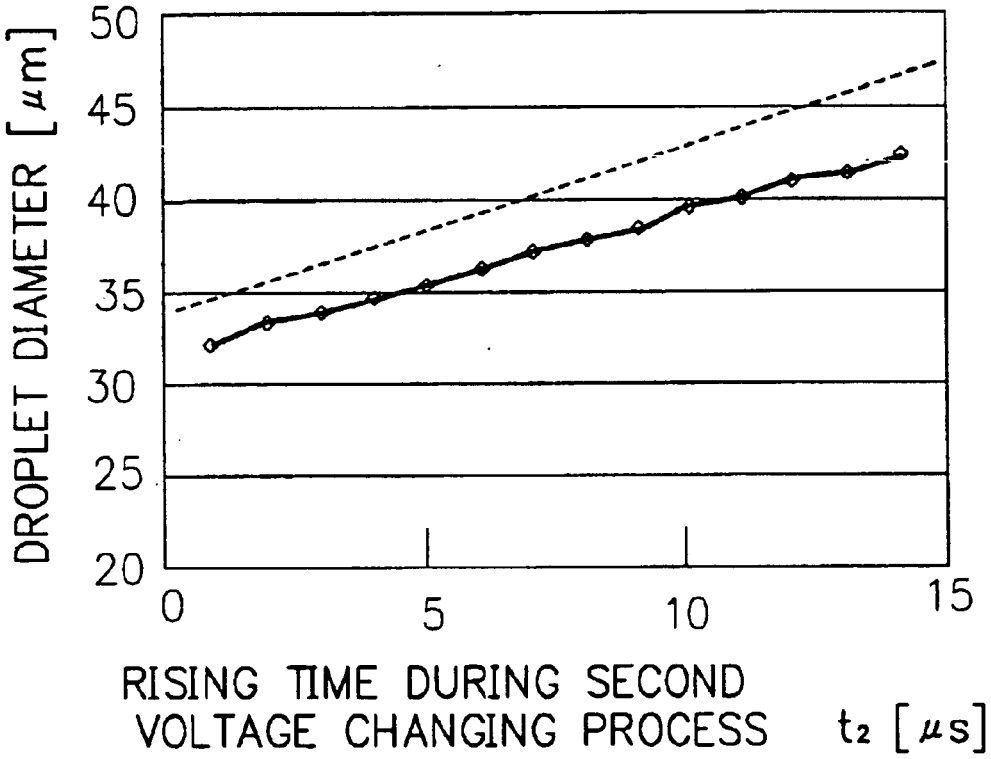
FIG. 8 is a view useful in explaining the effects of this embodiment.

FIG. 8 is a characteristic diagram showing the relationship between a rising time $t_2$ during the second voltage retaining process 56 and the ink droplet size. In this diagram, the solid line shows measured values obtained under the above-mentioned conditions, and the broken line shows converted values of the droplet size obtained based on Equations (3) and (4). As seen in FIG. 8, the theoretical values agree well with the experimental values despite a small difference in absolute value.

As is apparent from FIG. 8, the droplet size decreases linearly with the rising time $t_3$ within the range of $t_3<T_c$ ($T_c$: resonance frequency of the pressure wave). Accordingly, if a conventional "meniscus control (pull and push)" waveform such as that shown in FIG. 17 is used, it is also advantageous to set the rising time $t_3$ as short as possible. However, even if the rising time $t_3$ can be set at 0 μs, a droplet size of about 28 μm is predicted from FIG. 8 and it is difficult to obtain fine droplets in the order of 20 μm.

SECOND EMBODIMENT

Figure 9:
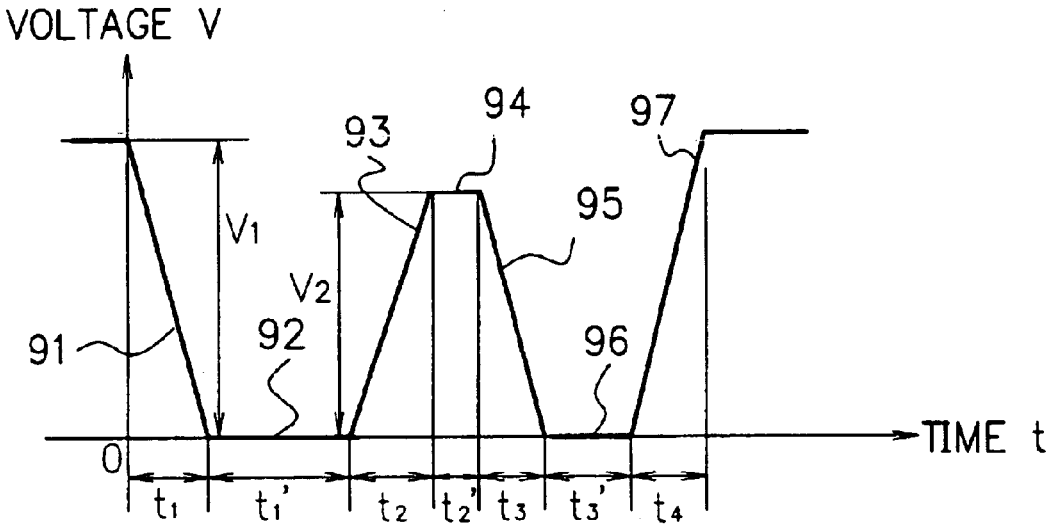
FIG. 9 is a waveform diagram showing the configuration of driving voltage waveforms used in a method for driving the ink jet recording head as a second embodiment of the present invention.

FIG. 9 is a waveform diagram showing the configuration of a driving voltage waveform used for a method for driving an ink jet recording head as a second embodiment of the present invention.

In this second embodiment, the amplified driving voltage waveform signal comprises a first voltage changing process 91 for lowering a voltage V applied to the piezoelectric actuator 4 ($V_1 \rightarrow 0$) to inflate the pressure generating chamber 2 to thereby cause meniscus to recede, a first voltage retaining process 92 for retaining the lowered applied voltage V for a certain period of time (time $t_1'$) ($0 \rightarrow 0$), a second voltage changing process 93 for raising the voltage ($0 \rightarrow V_2$) to compress the pressure generating chamber 2 to eject the ink droplets 1, a second voltage retaining process 94 for retaining the raised applied voltage V for a certain period of time (time $t_2'$) ($V_2 \rightarrow V_2$), a third voltage changing process 95 for lowering the voltage ($V_2 \rightarrow 0$) to inflate the pressure generating chamber 2 again, a third voltage retaining process 96 for retaining the lowered applied voltage V for a certain period of time (time $t_3'$) ($0 \rightarrow 0$), and a fourth voltage changing process 97 for raising the voltage ($0 \rightarrow V_1$) to generate a pressure wave for restraining reverberation. The voltage changing times $t_2$ and $t_3$ during the second and third voltage changing processes 93 and 95 are set to have such lengths as shown below, relative to the resonance frequency $T_c$ of the pressure wave generated in the pressure generating chamber 2.

$$0<t_2<T_c/2$$

$$0<t_3<T_c/2$$

In this connection, to efficiently prevent the pressure wave from reverberating, it is preferable to set a voltage changing time $t_4$ during the fourth voltage changing process 97 to have such a length as shown below, relative to the resonance frequency $T_c$ of the pressure wave generated in the pressure generating chamber 2.

$$0<t_4<T_c/2$$

That is, this configuration is substantially similar to that of the first embodiment except that the fourth voltage changing process 97 and the accompanying third voltage retaining process 96 are provided.

Next, ejection experiments were conducted for the ink jet driving method of the second embodiment under the following driving voltage waveform conditions:

- reference voltage $V_1$=10 V
- voltage change amount $V_2$=8V during ejection, that is, during the second voltage changing process 93
- voltage changing time $t_1$=3 μs during the first voltage changing process 91
- voltage retaining time $t_1'$=4 μs during the first voltage retaining process 92
- voltage changing time $t_2$=2 μs during the second voltage changing process 93
- voltage retaining time $t_2'$=0 μs during the second voltage retaining process 94 voltage changing time $t_3$=2 μs during the third voltage changing process 95 voltage retaining time $t_3'$=2 μs during the third voltage retaining process 96 voltage changing time $t_4$=3 μs during the fourth voltage changing process 97

Figure 10:
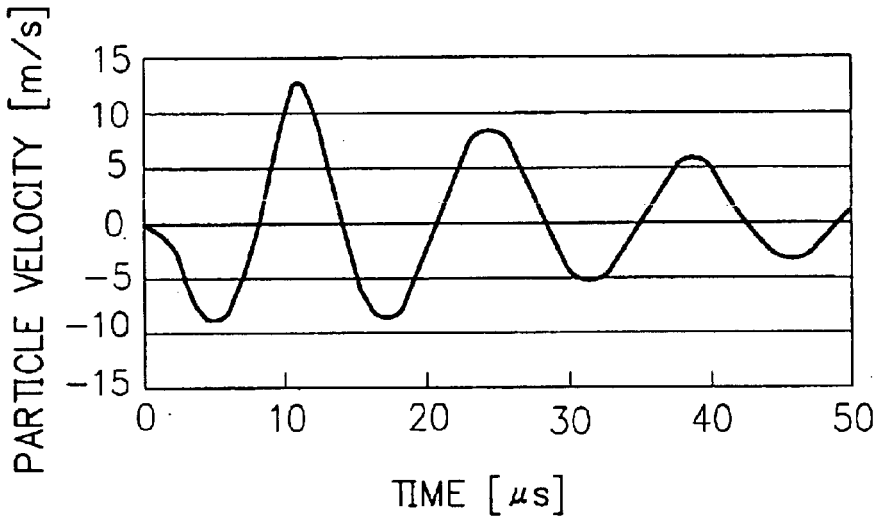
FIG. 10 is a view useful in explaining the effects of this embodiment.
Figure 10:
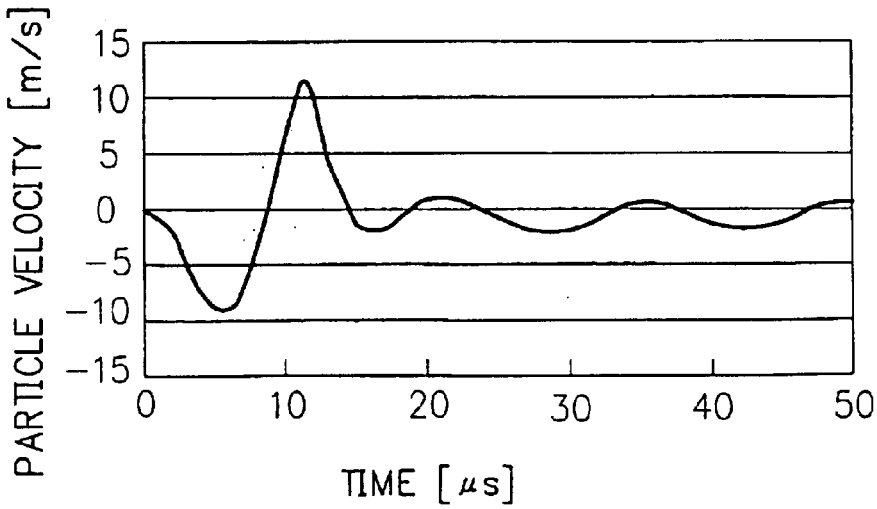

Then, variations in ink volume velocity occurring in the nozzle portion 7 when the apparatus is driven with the driving voltage waveform in FIG. 9 under the above voltage conditions were calculated using Equations (3) and (4). The results of the calculation are shown in FIG. 10(*b*) as particle velocity.

Next, for comparison with the first embodiment, ejection experiments were conducted using the conventional driving voltage waveform in FIG. 4. That is, the following conditions were set:

reference voltage $V_1$=10 V voltage change amount $V_2$=8V during ejection, that is, during the second voltage changing process 93 voltage changing time $t_1$=3 μs during the first voltage changing process 91 voltage retaining time $t_1'$=4 μs during the first voltage retaining process 92 voltage changing time $t_2$=2 μs during the second voltage changing process 93 voltage retaining time $t_2'$=0 μs during the second voltage retaining process 94 voltage changing time $t_3$=2 μs during the third voltage changing process 95

Then, variations in ink volume velocity occurring in the nozzle portion 7 when the apparatus is driven with the driving voltage waveform under the above voltage conditions were calculated using Equations (3) and (4). The results of the calculation are shown in FIG. 10(*a*) as particle velocity.

If the apparatus is driven with the driving voltage waveform (FIG. 4) of the first embodiment, ink droplets smaller than the nozzle diameter can be ejected due to the first to third voltage changing processes 41, 43, and 45, whereas the ejection may be unstable. This is because if the apparatus is driven with the driving voltage waveform (FIG. 4) of the first embodiment, the pressure wave reverberates significantly even after the ejection, in other words, even after the first wave associated with the ejection of ink droplets, thereby making the ejection unstable, as seen in FIG. 10(*a*). The results of the experiments conducted by the inventors show that such significant pressure wave reverberation is likely to make generation of satellites unstable and to cause inappropriate ejection particularly at a high driving frequency.

In contrast, if the apparatus is driven with the driving voltage waveform (FIG. 9) of the second embodiment, since the fourth voltage changing process 97 is executed after the first to third voltage changing processes 91, 93, and 95, a pressure wave occurs which compensates for the occurring pressure wave reverberation, thereby significantly attenuating the amplitude of the volume velocity after the first wave as seen in FIG. 10(*b*). Consequently, the pressure wave is effectively prevented from reverberating after the ejection. Therefore, fine droplets can be stably ejected even at a high driving frequency according to the driving method of the second embodiment.

Figure 11:
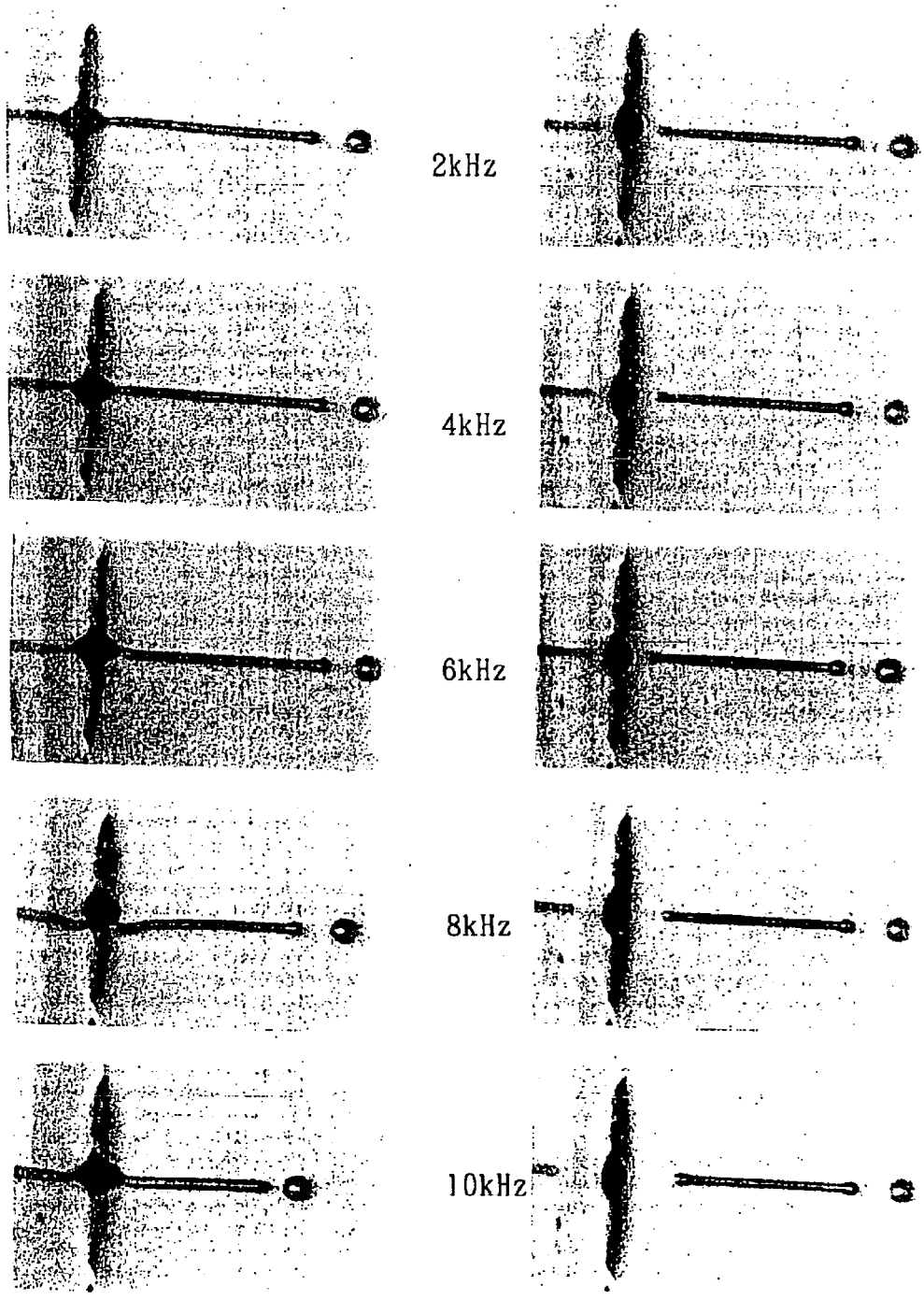
FIG. 11 is a view useful in explaining the effects of this embodiment, showing how ejection varies depending on whether or not reverberation is restrained.
Figure 12:
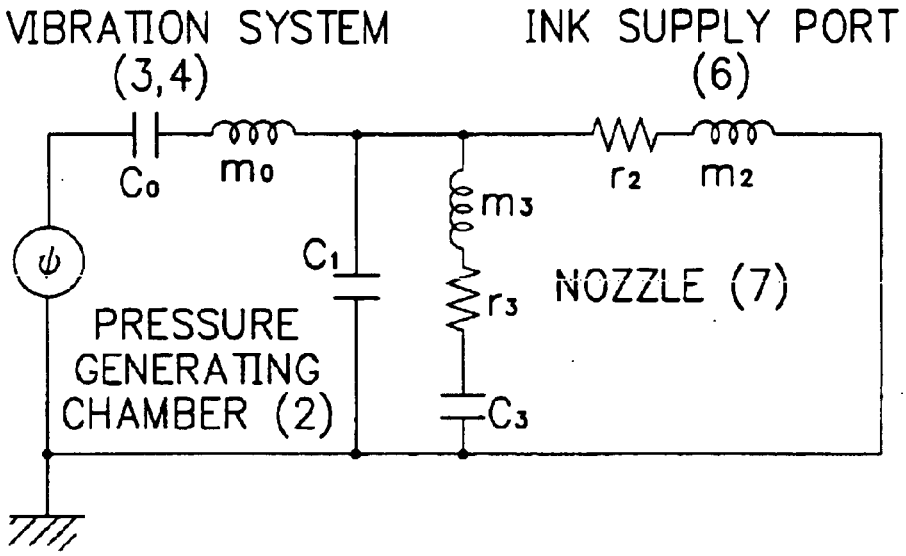
FIG. 12 is a view showing a diagram of an equivalent electric circuit in which an inkjet recording head applied to the present invention is filled with an ink.
Figure 12:
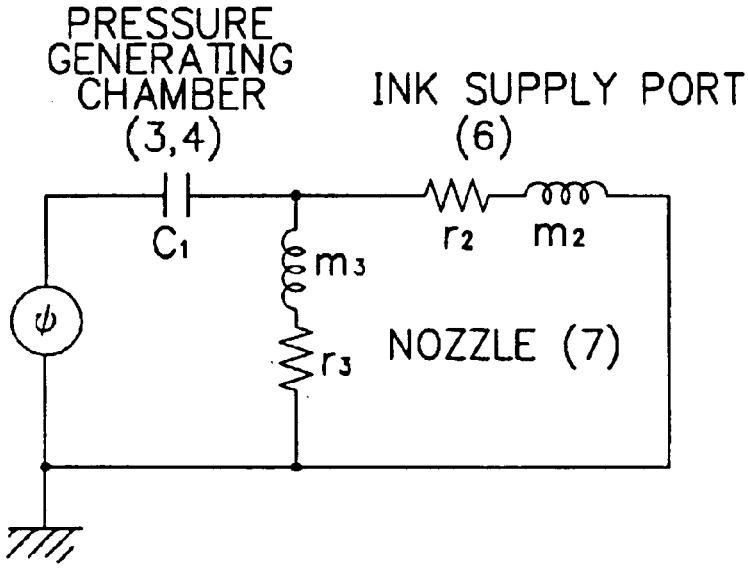
Figure 13:
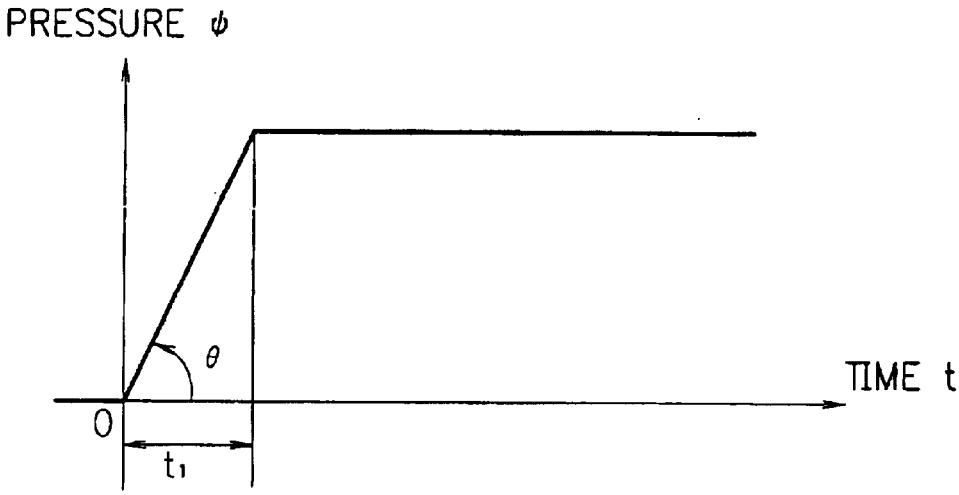
FIG. 13 is a waveform diagram useful in explaining a method for driving the ink jet recording head.
Figure 13:
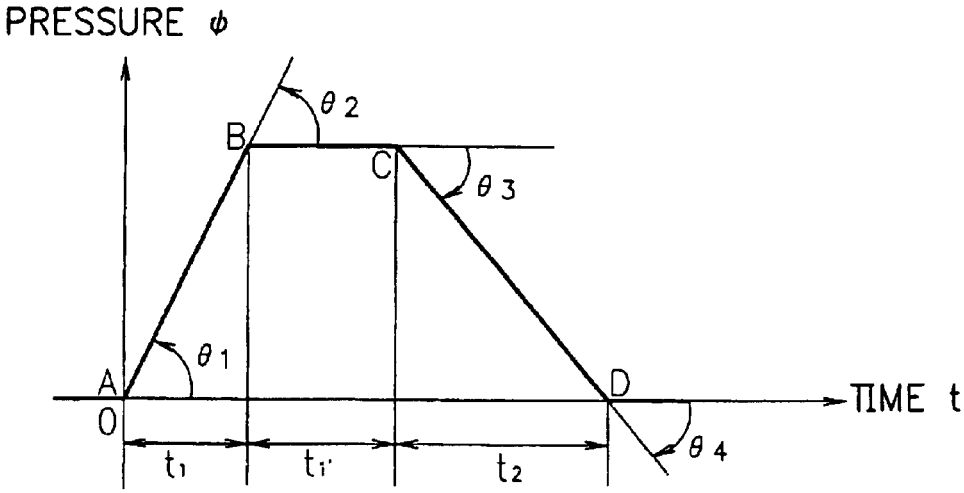
Figure 14:
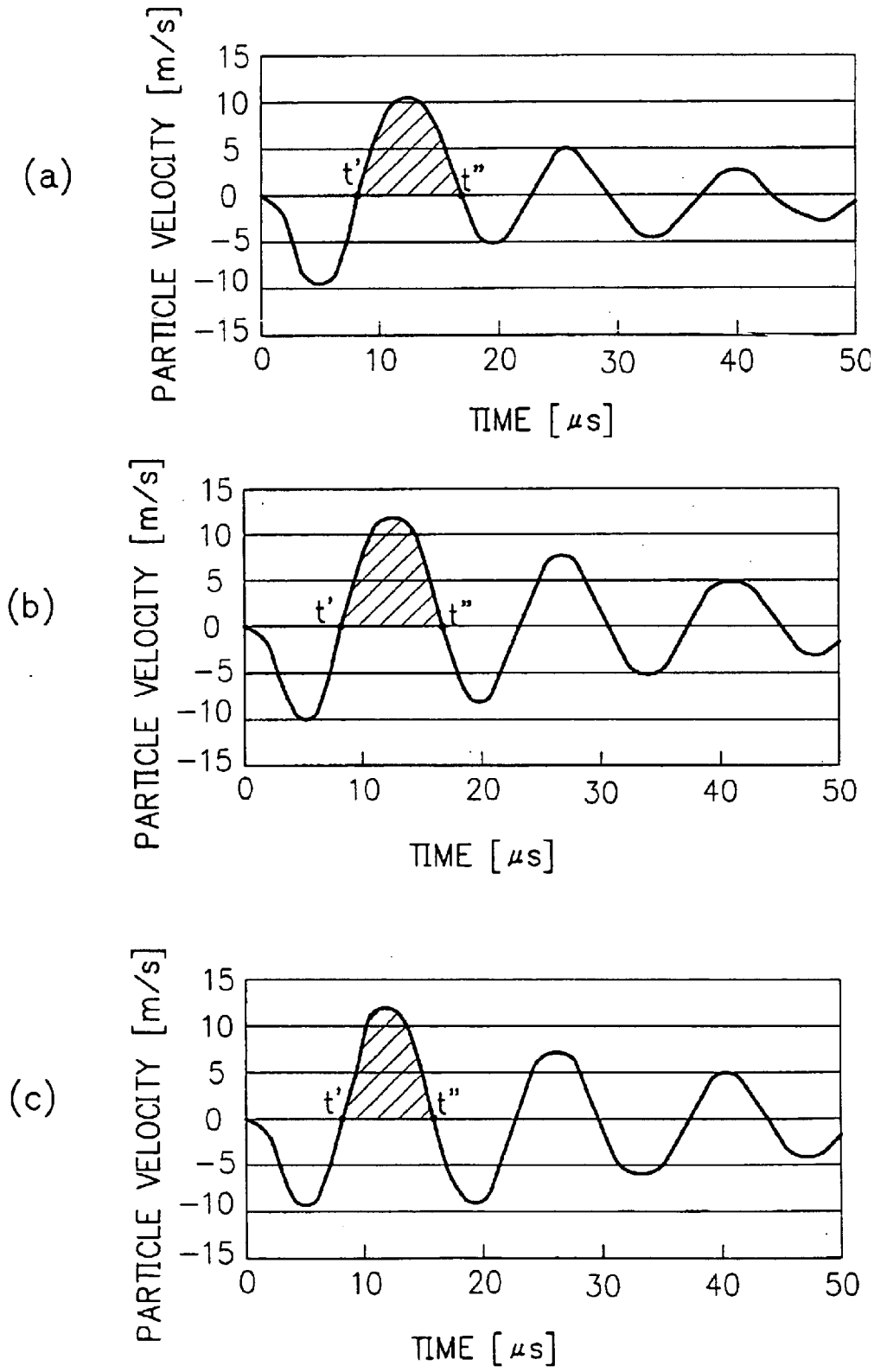
FIG. 14 is a waveform diagram useful in explaining the method for driving the ink jet recording head.
Figure 15:
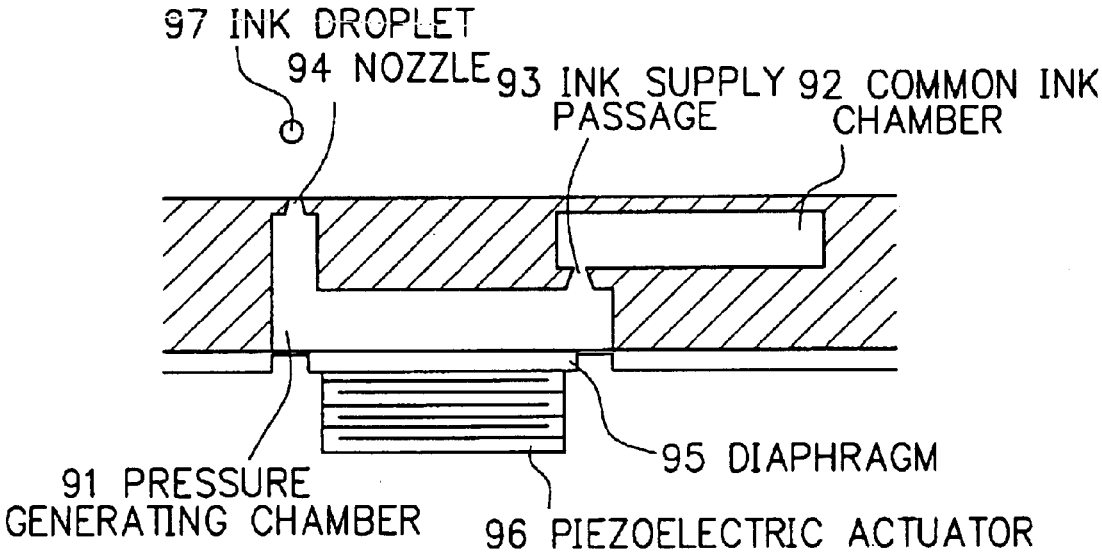
FIG. 15 is a sectional view useful in explaining a conventional technique, schematically showing the basic configuration of an ink jet recording head called a "Kyser type" and belonging to on-demand ink jet recording heads.
Figure 16:
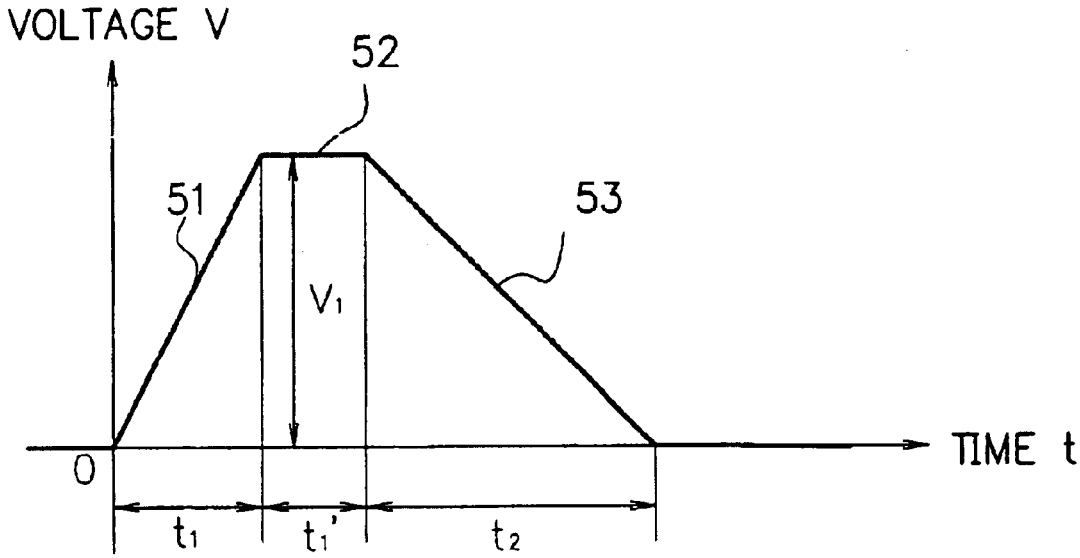
FIG. 16 is a waveform diagram showing the configuration of driving voltage waveforms used in a conventional method for driving a ink jet recording head.

FIG. 11 shows photographs showing how the ejection varies depending on whether or not the reverberation is restrained.

As is apparent from the photographs in FIG. 11, it has been assured that in the first embodiment (reverberation is not restrained), tails of ink droplets are bent at a driving frequency of 8 kHz or more and satellites fly unstably (Photo (a)), whereas in the second embodiment (reverberation is restrained), the ejection does not substantially vary even at 10 kHz (Photo (b)).

In the second embodiment, to efficiently restrain it is desirable to set the voltage changing time $t_4$ during the fourth voltage changing process 97 equal to or shorter than half of the resonance frequency $T_c$ of the pressure wave. Additionally, the pressure wave is most efficiently restrained from reverberating by setting the time interval ($t_2+t_2'+t_3+t_3'$) between a start time of the second voltage changing process 93 and a start time of the fourth voltage changing process 97, equal to or shorter than half of the resonance frequency $T_c$ of the pressure wave in the pressure generating chamber 2. This is because the pressure wave having a phase opposite to that of the pressure wave generated by the second voltage changing process 93 is generated to efficiently cancel the latter pressure wave effectively.

The embodiment of the present invention has been described in detail with reference to the drawings, but the specific configuration is not limited to this embodiment and changes to the design are embraced in the present invention as long as they do not deviate from the spirits thereof. For example, the shape of the nozzles and the ink supply holes is not limited to the taper. Likewise, the shape of the openings is not limited to the circle but may be a rectangle, triangle, or others. In addition, the positional relationship between the nozzle and the pressure generating chamber and the ink supply hole is not limited to the structures shown in the embodiments, but for example, the nozzle may of course be arranged in the center of the pressure generating chamber.

Further, in the above described first embodiment, the voltage (0 V) at the end of the first voltage changing process equals the voltage (0 V) at the end of the third voltage changing process. The present invention, however, is not limited to this, but these voltage may be different. In the above described second embodiment, the voltage changing times $t_2$, $t_3$, and $t_4$ of the second to fourth voltage changing processes 93, 95, and 97 are equal. The present invention, however, is not limited to this, but these voltage changing times may be separately set. In the second embodiment, the voltage at the end of the fourth voltage changing process equals the reference voltage. The present invention, however, is not limited to this, but this voltage may be set at a different value. In the above embodiments, the reference voltage is offset from 0 V. The present invention, however, is not limited to this, and the reference voltage may be set at an arbitrary value.

Additionally, the above described embodiments show the results of the experiments for the recording head having a pressure wave resonance frequency $T_c$ of 14 μs, but it has been confirmed that effects similar to those described in the above embodiments are obtained with a different resonance frequency $T_c$. If, however, fine droplets in the order of 20 μm are to be ejected, the resonance frequency is desirably set at 20 μs or less.

Further, the above described embodiments use the recording head of 30 μm diameter, but the present invention is not limited to this. An ink jet recording head including a nozzle having an opening diameter of 20 to 40 μm can be driven to eject droplets of 5 to 25 μm size. The practical lower limit of the nozzle diameter is expected to decrease to about 20 μm if the blocking problem is solved in the future.

Moreover, the above described embodiments use the Kyser ink jet recording head, but the present invention is not limited to this type.

INDUSTRIAL APPLICABILITY

As described above, according to the configuration of the present invention, fine ink droplets of a size smaller than the nozzle diameter can be stably ejected at a high driving frequency. Specifically, fine ink droplets in the order of 20 μm can be stably ejected at a high frequency even with a nozzle diameter of 30 μm.

What is claimed is:

1. A method for driving an ink jet recording head, comprising applying a driving voltage to an electro-mechanical converter to deform the electro-mechanical converter to thereby change a pressure in the pressure generating chamber filled with ink, thus ejecting ink droplets with a size of about 5 to about 25 μm through a nozzle in communication with the pressure generating chamber, wherein said applying said driving voltage comprises:

a first voltage changing process which applies a voltage in a direction that increases a volume of said pressure generating chamber;

a second voltage changing process which applies a voltage in a direction that reduces the volume of said pressure generating chamber; and a third voltage changing process which applies a voltage in a direction that increases the volume of said pressure generating chamber again, wherein voltage changing times $t_2$ and $t_3$ during the second and third voltage changing processes have such lengths as shown below, relative to a resonance frequency $T_c$ of a pressure wave generated in the pressure generating chamber:

$$0<t_2<T_c/2$$

$$0<t_3<T_c/2 \text{ and,}$$

wherein said nozzle has an opening diameter of about 20 to less than 30 μm, and wherein said driving voltage changing times are based upon said resonance frequency.

2. A method for driving an ink jet recording head, comprising applying a driving voltage to an electro-mechanical converter to deform the electro-mechanical converter to thereby change a pressure in a pressure generating chamber filled with ink, thus ejecting ink droplets with a size of about 5 to 25 μm through a nozzle in communication with the pressure generating chamber, wherein said applying of said driving voltage comprises:

a first voltage changing process which applies a voltage in a direction that increases a volume of said pressure generating chamber;

a second voltage changing process which applies a voltage in a direction that reduces the volume of said pressure generating chamber; and a third voltage changing process which applies a voltage in a direction that increases the volume of said pressure generating chamber again, wherein voltage changing times $t_2$ and $t_3$ during the second and third voltage changing processes have such lengths as shown below, relative to a resonance frequency $T_c$ of a pressure wave generated in the pressure generating chamber:

$$0<t_2<T_c/2$$

$$0<t_3<T_c/2,$$

wherein said nozzle has an opening diameter of about 20 to less than 30 μm, and wherein a start time of said third voltage changing process is about the same as an end time of said second voltage changing process, and wherein said driving voltage changing times are based upon said resonance frequency.

3. A method for driving an ink jet recording head, comprising applying a driving voltage to an electro-mechanical converter to deform the electro-mechanical converter to thereby change a pressure in the pressure generating chamber filled with ink, thus ejecting ink droplets of a size of about 5 to 25 μm through a nozzle in communication with the pressure generating chamber, wherein said applying said driving voltage comprises:

a first voltage changing process which applies a voltage in a direction that increases a volume of said pressure generating chamber;

a second voltage changing process which applies a voltage in a direction that reduces the volume of said pressure generating chamber;

a third voltage changing process which applies a voltage in a direction that increases the volume of said pressure generating chamber again; and a fourth voltage changing process which applies voltage in a direction that reduces the volume of said pressure generating chamber, after said first voltage changing process, said second voltage changing process, and said third voltage changing process, wherein voltage changing times $t_2$ and $t_3$ during the second and third voltage changing processes have such lengths as shown below, relative to a resonance frequency $T_c$ of a pressure wave generated in the pressure generating chamber:

$$0<t_2<T_c/2$$

$$0<t_3<T_c/2 \text{ and,}$$

wherein said nozzle has an opening diameter of about 20 to less than 30 μm, and wherein said driving voltage changing times are based upon said resonance frequency.

4. A method for driving an ink jet recording head comprising applying a driving voltage to an electro-mechanical converter to deform the electro-mechanical converter to thereby change a pressure in the pressure generating chamber filled with ink, thus ejecting ink droplets of a size of about 5 to 25 μm through a nozzle in communication with the pressure generating chamber, wherein said applying said driving voltage comprises:

a first voltage changing process which applies a voltage in a direction that increases a volume of said pressure generating chamber;

a second voltage changing process which applies a voltage in a direction that reduces the volume of said pressure generating chamber;

a third voltage changing process which applies a voltage in a direction that increases the volume of said pressure generating chamber again, and a fourth voltage changing process which applies voltage in a direction that reduces the volume of said pressure generating chamber, after said first voltage changing process, said second voltage changing process, and said third voltage changing process, wherein voltage changing times $t_2$ and $t_3$ during the second and third voltage changing processes have such lengths as shown below, relative to a resonance frequency $T_c$ of a pressure wave generated in the pressure generating chamber:

$$0<t_2<T_c/2$$

$$0<t_3<T_c/2,$$

wherein said nozzle has an opening diameter of about 20 to less than 30 $\mu$m, and wherein a voltage changing time $t_4$ during said fourth voltage changing process has a length relative to the resonance frequency $T_c$ of the pressure wave generated in said pressure generating chamber as follows:

$$0<t_4<T_c/2,$$

wherein said driving voltage changing times are based upon said resonance frequency.

5. A method for driving an ink jet recording head comprising applying a driving voltage to an electro-mechanical converter to deform the electro-mechanical converter to thereby change a pressure in the pressure generating chamber filled with ink, thus ejecting ink droplets of a size of about 5 to 25 $\mu$m through a nozzle in communication with the pressure generating chamber, wherein said applying said driving voltage comprises:

a first voltage changing process which applies a voltage in a direction that increases a volume of said pressure generating chamber;

a second voltage changing process which applies a voltage in a direction that reduces the volume of said pressure generating chamber;

a third voltage changing process which applies a voltage in a direction that increases the volume of said pressure generating chamber again;

a fourth voltage changing process which applies voltage in a direction that reduces the volume of said pressure generating chamber, after said first voltage changing process, said second voltage changing process, and said third voltage changing process; wherein voltage changing times $t_2$ and $t_3$ during the second and third voltage changing processes have such lengths as shown below, relative to a resonance frequency $T_c$ of a pressure wave generated in the pressure generating chamber:

$$0<t_2<T_c/2$$

$$0<t_3<T_c/2,$$

wherein said nozzle has an opening diameter of about 20 to less than 30 $\mu$m, wherein a voltage changing time $t_4$ during said fourth voltage changing process has a length relative to the resonance frequency $T_c$ of the pressure wave generated in said pressure generating chamber as follows:

$$0<t_4<T_c/2,$$

and wherein a time interval between a start time of said second voltage changing process and a start time of said fourth voltage changing process is set substantially half the length of the resonance frequency $T_c$ of the pressure wave generated in said pressure generating chamber, and wherein said driving voltage changing times are based upon said resonance frequency.

* * * * *